US011331667B2

(12) United States Patent
Davis et al.

(10) Patent No.: US 11,331,667 B2
(45) Date of Patent: May 17, 2022

(54) APPARATUS AND METHOD FOR POSITIONING PARTICLES INSIDE A CHANNEL

(71) Applicant: Nokia Technologies Oy, Espoo (FI)

(72) Inventors: Ian Davis, Dublin (IE); Kevin Nolan, Dublin (IE)

(73) Assignee: Nokia Technologies Oy, Espoo (FI)

( * ) Notice: Subject to any disclaimer, the term of this patent is extended or adjusted under 35 U.S.C. 154(b) by 184 days.

(21) Appl. No.: 16/634,350

(22) PCT Filed: Jul. 17, 2018

(86) PCT No.: PCT/FI2018/050551
§ 371 (c)(1),
(2) Date: Jan. 27, 2020

(87) PCT Pub. No.: WO2019/025661
PCT Pub. Date: Feb. 7, 2019

(65) Prior Publication Data

US 2020/0384463 A1 Dec. 10, 2020

(30) Foreign Application Priority Data

Aug. 4, 2017 (EP) ..... 17185008

(51) Int. Cl.
*B01L 3/00* (2006.01)

(52) U.S. Cl.
CPC ..... *B01L 3/50273* (2013.01); *B01L 3/50851* (2013.01); *B01L 3/502761* (2013.01);
(Continued)

(58) Field of Classification Search
CPC ..... B01L 3/50273; B01L 3/502761; H01L 41/053; G01N 33/491
See application file for complete search history.

(56) References Cited

U.S. PATENT DOCUMENTS

2004/0066703 A1 4/2004 Sparey-taylor et al.
2010/0078384 A1* 4/2010 Yang ..... G01N 33/491 210/645

(Continued)

FOREIGN PATENT DOCUMENTS

EP 1202811 A1 5/2002
WO 2001/05513 A1 1/2001
WO 2011/113064 A1 9/2011

OTHER PUBLICATIONS

Office action received for corresponding European Patent Application No. 17185008.4, dated Mar. 11, 2020, 5 pages.

(Continued)

*Primary Examiner* — Brian J. Sines
(74) *Attorney, Agent, or Firm* — Harrington & Smith

(57) ABSTRACT

An apparatus and method are disclosed for modifying the position of particles distributed in a fluid flow in a channel, comprising a channel formed by two substrates, each of the two substrates being on opposite sides of the channel, each substrate having a preselected periodic profile pattern along a length of the channel, and a transducer, wherein one of the substrates is between the transducer and the channel, the transducer to generate an acoustic standing wave within the channel with at least one node or antinode positioned within the channel.

9 Claims, 7 Drawing Sheets

(52) U.S. Cl.
CPC ... *B01L 2200/0652* (2013.01); *B01L 2300/12* (2013.01); *B01L 2400/0436* (2013.01); *B01L 2400/0454* (2013.01); *B01L 2400/0496* (2013.01)

(56) References Cited

U.S. PATENT DOCUMENTS

| | | | | |
|---|---|---|---|---|
| 2014/0008307 | A1 | 1/2014 | Guldiken et al. | |
| 2014/0011240 | A1* | 1/2014 | Lipkens ..... | H01L 41/053 435/71.1 |
| 2015/0192546 | A1 | 7/2015 | Weitz et al. | |
| 2016/0319270 | A1 | 11/2016 | Lipkens et al. | |

OTHER PUBLICATIONS

Extended European Search Report received for corresponding European Patent Application No. 17185008.4, dated Dec. 20, 2017, 9 pages.

International Search Report and Written Opinion received for corresponding Patent Cooperation Treaty Application No. PCT/FI2018/050551, dated Sep. 7, 2018, 14 pages.

* cited by examiner

APPARATUS AND METHOD FOR POSITIONING PARTICLES INSIDE A CHANNEL

RELATED APPLICATION

This application was originally filed as PCT Application No. PCT/FI2018/050551 filed Jul. 17, 2018 which claims priority benefit from EP Application No. 17185008.4 filed Aug. 4, 2017.

TECHNICAL FIELD

Aspects relate, in general, to apparatus and methods for positioning particles inside a channel.

BACKGROUND

In the field of thermal management, microchannel cooling can be used to dissipate large heat fluxes. Liquid can be passed through conduits or channels at micron scales (of the order of 100 microns) to remove heat via conduction and convection. Such channels can be used for the thermal management of integrated circuits (ICs), photonics and power amplifier devices.

SUMMARY

According to an example, there is provided an apparatus for modifying the position of particles distributed in a fluid flow in a channel, comprising a channel formed by two substrates, each of the two substrates being on opposite sides of the channel, each substrate having a preselected periodic profile pattern along a length of the channel, and a transducer, wherein one of the substrates is between the transducer and the channel, the transducer to generate an acoustic standing wave within the channel with at least one node or antinode positioned within the channel.

The pattern may form an interface having an acoustically reflective surface in order to reflect acoustic energy back into the channel to maintain the standing wave.

Each substrate may comprise a semi-conductor material.

The apparatus may further comprise a material layer between the patterned substrate and the channel, the material layer having an acoustic impedance selected to substantially match that of a fluid to flow within the channel. The material layer may comprise polydimethylsiloxane.

The profile of the patterned substrate may vary in a direction parallel to the channel. The interfaces between the channel and material layer may be perforated at intervals to provide pores at the upper and lower channel interface that are out-of-phase with each other. The profile may comprise a series of notches and projections. A distance from the base of a notch to the acoustically transmissive surface may be an integer multiple of a distance from the top of a projection to the acoustically transmissive surface.

According to an example, there is provided an electronic cooling device.

According to an example, there is provided a method for modifying the position of particles distributed in a fluid flow in a channel, comprising the steps of providing two substrates, forming a channel between the two substrates, each of the two substrates being on opposite sides of the channel, each substrate having a preselected periodic profile pattern along a length of the channel, providing a transducer, wherein one of the substrates is between the transducer and the channel, and generating an acoustic standing wave across the channel with at least one node or antinode within the channel.

An acoustic force may be applied to the particles to cause the particles to migrate sinusoidally along the length of the channel.

According to an example, there is provided a method for cooling a heat source located near the channel.

According to an example, there is provided a method for separating biological particles into individual layers using acoustophoretic forces.

The method may further comprise stretching polymer particles that may be present inside the channel using acoustophoretic forces inside the channel.

BRIEF DESCRIPTION OF THE DRAWINGS

Embodiments will now be described, by way of example only, with reference to the accompanying drawings, in which.

DESCRIPTION

Figure 1:
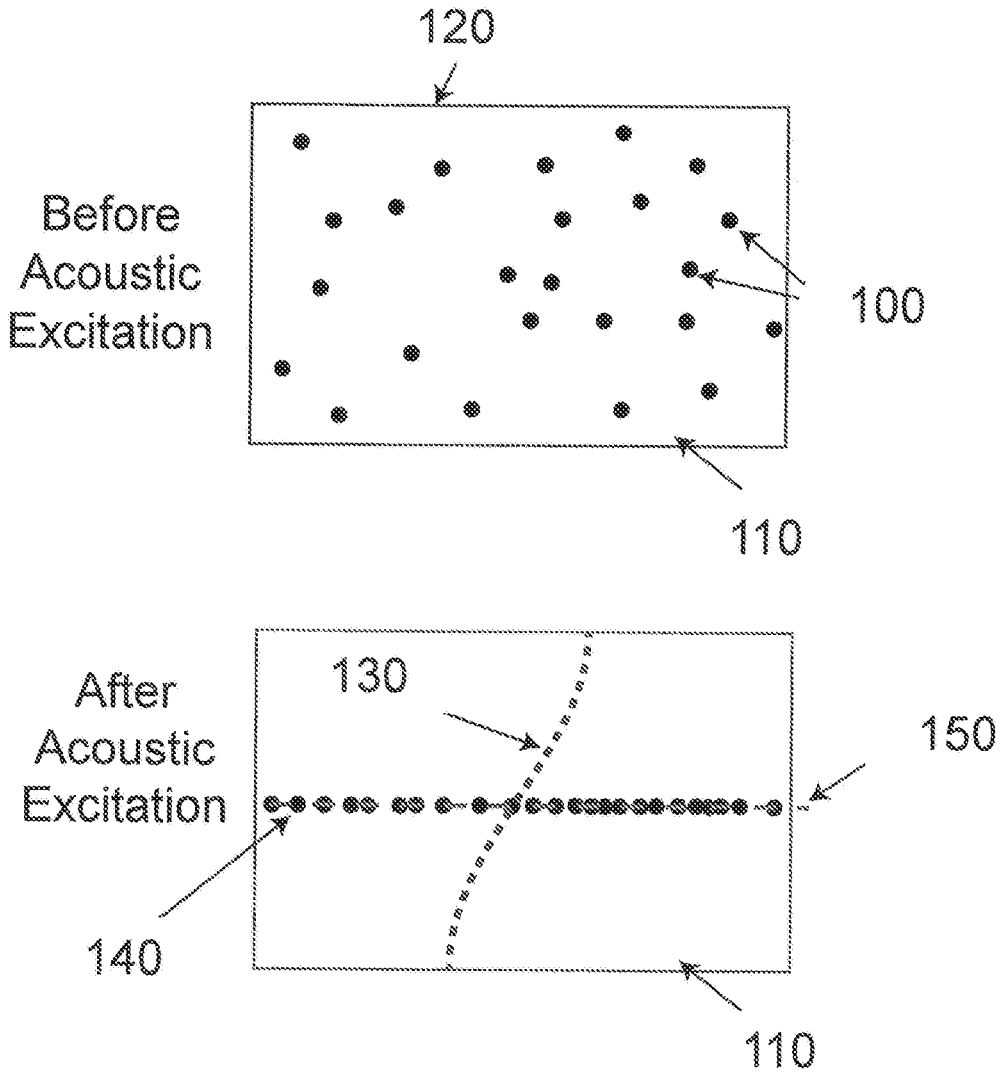
FIG. 1 is a schematic of a suspension of randomly distributed particles (top) and migrated particles (bottom) according to an example.

Examples are described below in sufficient detail to enable those of ordinary skill in the art to embody and implement the systems and processes herein described. It is important to understand that examples can be provided in many alternate forms and should not be construed as limited to the examples set forth herein.

Accordingly, while examples can be modified in various ways and take on various alternative forms, specific examples thereof are shown in the drawings and described in detail below as examples. There is no intent to limit to the particular forms disclosed. On the contrary, all modifications, equivalents, and alternatives falling within the scope of the appended claims should be included. Elements of the examples are consistently denoted by the same reference numerals throughout the drawings and detailed description where appropriate.

The terminology used herein to describe examples is not intended to limit the scope. The articles "a," "an," and "the" are singular in that they have a single referent, however the use of the singular form in the present document should not preclude the presence of more than one referent. In other words, elements referred to in the singular can number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

According to an example, there is provided a system and method that introduces particle migration and is used to break up clumps of particles using pressure waves. Heat transfer is significantly increased by enhancing the amount of particle migration (and hence fluid mixing) within a carrier fluid. This is achieved without any significant pump overhead costs associated with pumping the carrier fluid. Increases in convective heat transfer rates of 10× can be observed when significant mixing is introduced.

Acoustophoresis is a phenomenon in ultrasonic acoustics: at high frequencies, acoustic wavelengths get shorter. At frequencies in the MHz range, acoustic wavelengths are on the scale of hundreds of microns and therefore on a similar length scale to microparticles. Accordingly, small (microscale and below) particles will act as point-scatterers of an on-coming acoustic wave. If such small particles are distributed within a carrier fluid placed inside a standing pressure field at such high frequencies, the particles will experience a steady radiation force. An example of a chamber/channel at resonance is shown in FIG. 1. As shown (top), a suspension of small particles 100 is initially distributed randomly in a fluid medium 110 within a microchannel or microchamber 120. In an example, the particles are less compressible than the fluid medium. When a standing wave 130 is excited within the microchamber/channel (bottom), a steady acoustic radiation force is applied to the particles which causes them to migrate 140 to the node 150 of the standing wave. This demonstrates how such a radiation force causes such particles to amalgamate at specific locations of the standing waves. Depending on the ratio of the compressibilities of the particles and the carrier fluid, the particles will either be directed toward the nodes (zeros) or antinodes (peaks) of the standing acoustic pressure field.

According to an example, there is provided an apparatus and method for increasing heat transfer based on enhancing migration of particles distributed within a carrier fluid. Application of an acoustophoretic radiation force can be used to enhance thermal conductivity of a liquid in a microchannel.

Figure 2:
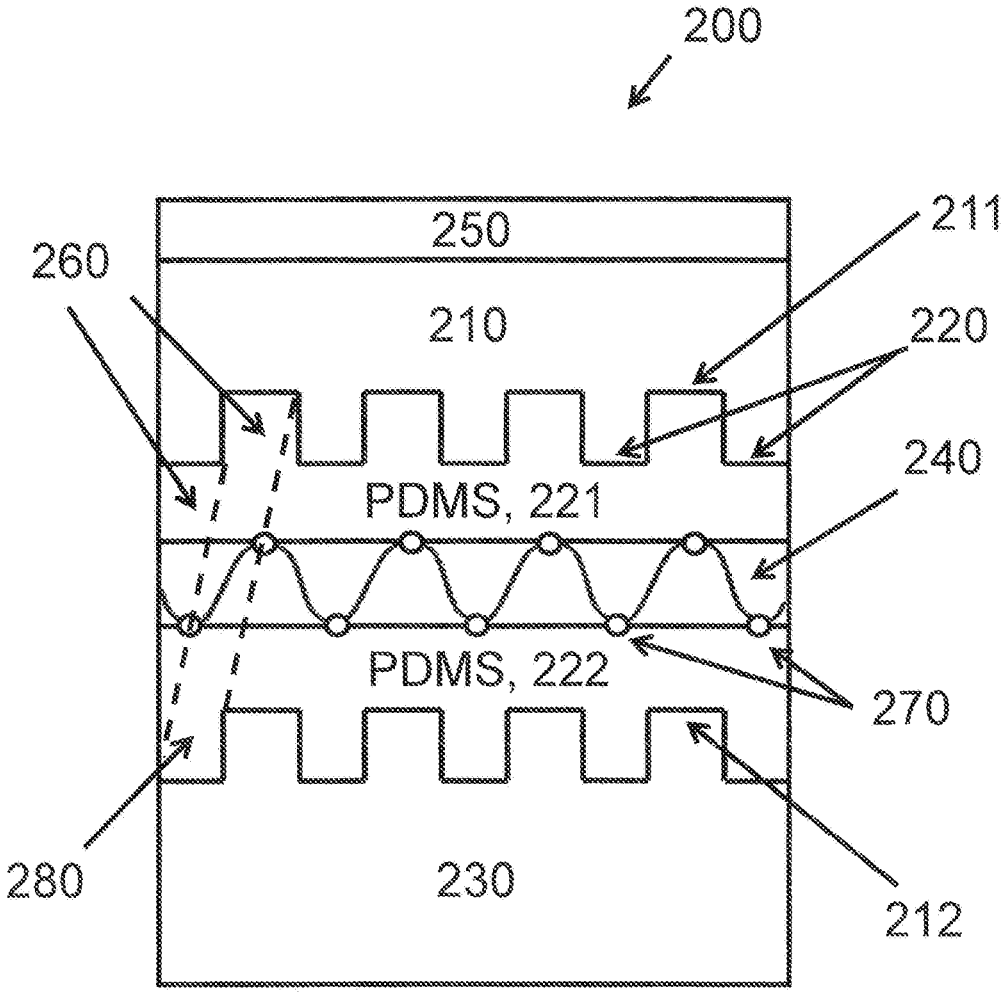
FIG. 2 is a schematic of an apparatus for positioning particles inside a channel according to an example.

An apparatus according to an example is shown in FIG. 2. The apparatus 200 comprises an upper substrate 210, patterned with trenches 220, and a lower substrate 230, with an identical, yet out-of-phase pattern of trenches. The patterned or profiled substrates are provided on either side of a microchannel 240. The pattern can be a preselected profile, such as a square-wave or rectangular profile. The preselected profiles need not be identical and are not limited in pattern-shape. They may be provided 180 degrees out-of-phase with one another, as shown in FIG. 2 for example, or may be provided with another phase difference. In the example of FIG. 2, the phase difference, or difference in alignment, between the features of the profiled substrate surfaces means that a trench in the top substrate 210 is directly opposite a peak in the bottom substrate 230, and vice versa. Various profiles for the surfaces of the substrates may be used, and the profiles may not be the same. For example, substrate 210 may have a sawtooth profile, and substrate 230 may have a sinusoidal profile. The peaks of the sinusoidal profile may be misaligned with the peaks of the sawtooth profile by some degree, or alternatively, as the profiles are structurally dissimilar, they may be aligned (i.e. peak to peak and so on), the reason for which will become apparent. In an example, one of the substrates 210, 230 may be devoid of a profile, and may be substantially flat.

An ultrasonic device, such as a piezoelectric device 250, induces a pressure wave corresponding to the span-wise (i.e. between substrates 210 and 230 as opposed to length-wise along the channel 240) resonance frequency, of the channel 240. This causes migration of the particles dispersed in the carrier fluid within the channel as they move through the channel. As a carrier fluid is pumped though the microchannel (from left to right), the span-wise position of the acoustic standing waves 260 changes due to the crenulations in the solid substrates. The particles suspended in the fluid are forced to the node locations 270 of the acoustic pressure field 280, and thus experience a periodic oscillation in their span-wise position as indicated by the sinusoidal path superimposed on FIG. 1 as they travel through the channel. That is, the motion of the particles can be varied in a direction that is orthogonal to the direction of fluid flow, whereby to enhance mixing and improve the heat transfer capabilities of the system.

In an example, a piezoelectric device 250 is used as an ultrasonic wave source, which is mounted onto a hard, solid substrate 210 in the example of FIG. 2. As can be seen in FIG. 2, the solid substrate 210 is patterned with square crenulations on the far side to the acoustic source 250. A layer of Polydimethylsiloxane (PDMS) 321 is deposited below this solid substrate 210. PDMS is a soft elastomer that can be used in microchannel fabrication. The microchannel is also bound by PDMS layer 222 and a solid substrate 230 on the lower side. Substrate 230 is patterned with square crenulations that are 180 degrees out of phase with those of substrate 210, as shown in FIG. 2. That is, in the example of FIG. 2, the lower solid substrate 230 has identical crenulations to the upper substrate 210, but the crenulations are out-of-phase ($\pi/2$) with the crenulations of the upper substrate surface 210.

In the example of FIG. 2, microchannel 240 can be filled with water and a suspension of small particles. For example, the small particles may be spherical metallic or non-metallic particles or nanotubes that may be made from carbon. The fluid/particle mixture can be pumped left to right through the microchannel, or vice versa.

According to an example, the distance between the profiled surfaces of the two solid substrate surfaces 210, 230 is fixed such that a standing wave (fundamental mode) 280 is excited between the solid surfaces, as shown with the dashed lines in FIG. 2. This standing wave is induced by excitation of the piezoelectric source 250. In an example, since PDMS and water have almost identical acoustic impedances, very little (<1%) acoustic energy is reflected at the PDMS/water interfaces of the system as shown in FIG. 2. That is, the interfaces between the PDMS 221, 222 and the channel 240 are acoustically impedance matched so that an ultrasonic wave generated by source 250 can pass through the interfaces substantially unimpeded.

In an example, the fundamental mode is excited. As such, a single acoustic node is located at the mid-point between the irregularities in the profiles on the solid surfaces 211, 212 of the substrates 210, 230. Thus, in the example of FIG. 2, due to the crenulations at the solid surfaces 211, 212, the position of this acoustic node varies along the length of the channel 240. For example, as shown in FIG. 2, the crenulations at the solid surfaces 211, 212 are regular (with a uniform distribution) and the position of the node 270 moves up and down within the microchannel 240 as the longitudinal location is changed (as shown with large dots in FIG. 2). This span-wise shift in node position is equal to the height of the crenulations, and causes the acoustic radiation force acting on the particles to vary sinusoidally along the length of the microchannel, causing periodic span-wise migration of the particles as they move from left to right.

In an example, a higher order mode (above the fundamental mode) is excited. A plurality of acoustic nodes may be located around the mid-point between the irregularities in the profiles on the solid surfaces 211, 212 of the substrates 210, 230 (not shown).

Figure 3:
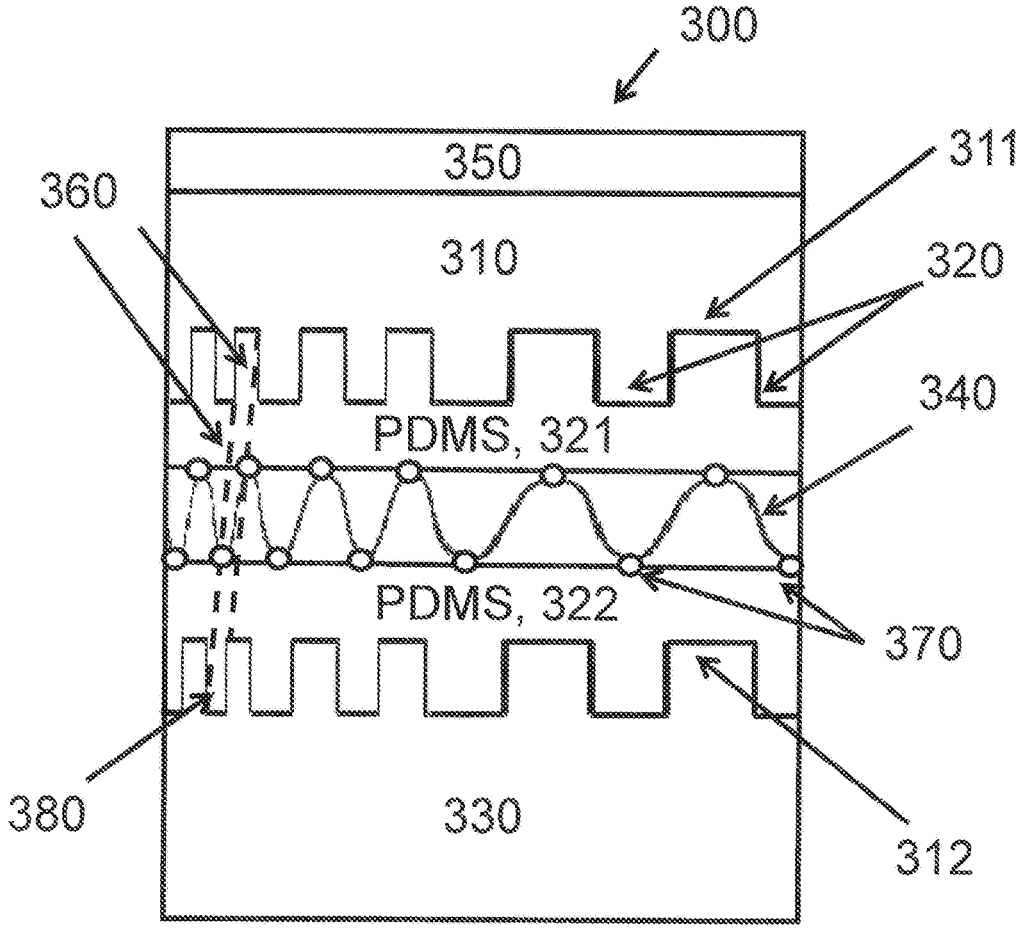
FIG. 3 is a schematic of an apparatus for positioning particles inside a channel according to an example.

FIG. 3 shows an alternative example to that shown in FIG. 2. In FIG. 3, the crenulations are modulated such that the spacing between the trenches varies. The standing wave induced by excitation of the acoustic source 350 may be gradually faded in or out at the peripheral regions of the channel. This is achieved as the resonance coupling strength with the span-wise channel is gradually lessened at the peripheries to weaken the acoustophoretic forces in these regions. The example of FIG. 3 may be used to concentrate particles in regions of hot spots to reduce temperature flux variations in localised regions (i.e. to iron out hot spots).

The techniques according to examples described herein allows positioning of particles span-wise across the width/breadth/diameter of a channel such that the span-wise location of the particles along the length of the microchannel is made to vary by selecting a cross-sectional geometry of an underlying hard substrate, and using materials with specific acoustic impedances to achieve this effect.

The acoustophoretic contrast factor for a solvent fluid and particle mixture is the ratio of the compressibility of the solvent to the compressibility of the particles. For example, a high acoustophoretic contrast factor indicates that the compressibilities of the particles and solvent are very different, and assuming a standing wave field, the particles will be sorted (as shown in FIG. 1).

Figure 4:
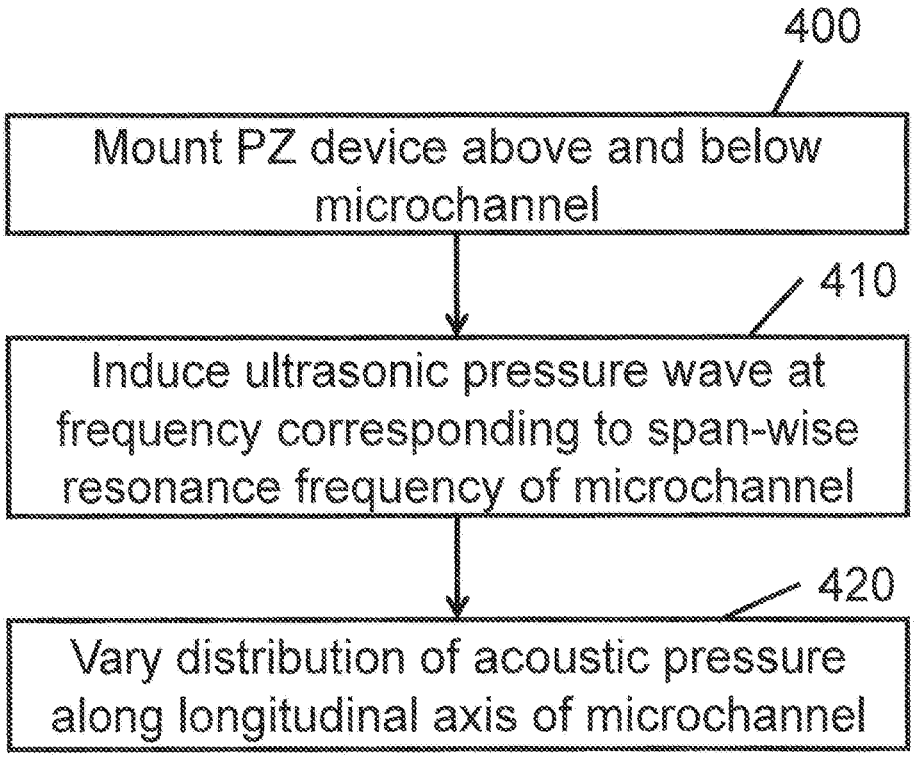
FIG. 4 is a flow chart of a method for introducing span-wise motion of microparticles inside a fluidic microchannel using acoustophoresis according to an example.
Figure 5:
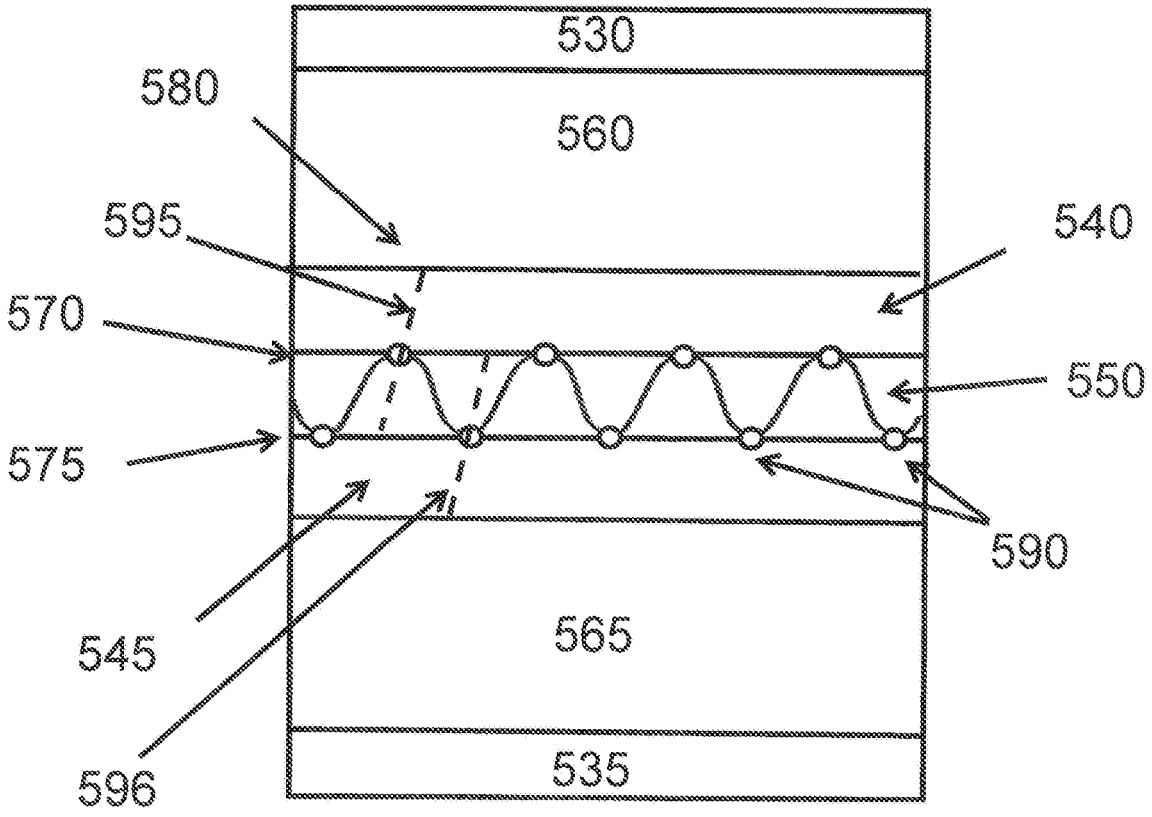
FIG. 5 is a schematic of an apparatus for enhancing heat transfer according to an example.

FIGS. 4 and 5 are schematic representations of examples that enhance convective heat transfer into a liquid inside a microchannel. FIG. 4 shows a method of introducing span-wise motion of microparticles inside a fluidic microchannel using acoustophoresis. At block 400 a piezoelectric (PZ) device is mounted above and below the microchannel 450. At block 410 an ultrasonic pressure wave at a frequency corresponding to the span-wise resonance frequency of the microchannel is induced. At block 420 the distribution of acoustic pressure along the longitudinal axis of the microchannel 450 is varied. For the crenulated embodiment shown in FIG. 3, this is achieved by varying the distribution of acoustic pressure along the longitudinal axis of the microchannel.

FIG. 5 shows two piezoelectric devices 530, 535 mounted above and below the laminate of PDMS 540, 545, microchannel 550 and upper and lower solid substrates 560, 565 (the fluid flow in the microchannel may be from left to right or vice-versa). Each piezoelectric device 530, 535 can be excited so as to induce an ultrasonic pressure wave at a frequency corresponding to the span-wise resonance frequency of the microchannel.

According to an example, the microchannel walls are fabricated from a thermally conductive material such as copper or aluminium. In the example of FIG. 5, the thermally conductive channel wall 570, 575 is perforated at selected points to allow acoustic transmission through the PDMS 540, 545 and into the microchannel 550, which causes a standing wave 580 to develop between the corresponding wall of the microchannel and a wall of the solid substrate. Depending on whether the perforations are at the upper or lower side of the channel, the node locations 590 will shift span-wise, as depicted in FIG. 5.

In an example, the microchannel walls 570, 575 can be perforated at intervals along the longitudinal axis, with a porosity close to or around 0.5. The PDMS ensures that the fluid will not leak from the channel where the walls are open. Not shown in FIG. 5 is the heat source which needs to be cooled. This can be located close to the microchannel wall on one side. Heat is transferred by conduction into the thermally-conductive channel walls, which is close to isentropic. The coolant fluid and microparticle mixture will remove this heat from the channel walls by convection as it passes the heated section, and the fluid mixture can be pumped to a secondary heat exchanger downstream where the heat can be removed from the microchannel.

In an example, pressure waves emitted from the piezoelectric devices can propagate through the upper/lower substrates and into the PDMS adjacent to the microchannel walls. The solid substrate thickness, density and local speed of sound can be selected to provide good impedance matching at both piezoelectric/substrate and substrate/PDMS interfaces to ensure efficient acoustic transmission. When the acoustic waves enter the PDMS, some of the acoustic energy may be reflected by the hard channel wall. However, the pressure waves will enter the channel where the walls are open due to the perforations, and be reflected from the far channel wall. For example, as shown in FIG. 5, a perforation in wall 570 of PDMS layer 540 enables a wave 595 to be generated as the acoustic wave travelling though the wall 570 at this perforation is reflected from wall 575. Similarly, a perforation in wall 575 of PDMS layer 545 enables a wave 596 to be generated as the acoustic wave travelling though the wall 575 at this perforation is reflected from wall 570.

According to an example, a microchannel diameter plus the thickness of a PDMS layer corresponds to half an acoustic wavelength at the frequency of the pressure wave, and therefore a standing wave is introduced through each perforation, as illustrated in FIG. 5B. This standing wave has a node (zero of acoustic pressure) at its midpoint. By periodically arranging the perforations such that the holes at the upper and lower channel walls are out-of-phase, the span-wise node location of the acoustic pressure field within the microchannel will vary sinusoidally in the longitudinal direction. Alternative variations in the phase or relative position of the perforations in the upper and lower PDMS walls can be used.

There is therefore an enhancement in the convective heat transfer afforded by the mixing of small particles distributed in the coolant within a microchannel. As the particles move close to the heated channel walls, they will remove heat from the channel walls and increase in temperature. In normal laminar flow with limited mixing, the particles close to the walls will reach a similar temperature to the channel walls, and the rate of heat transfer will therefore reduce. Conversely, microparticles close to the centre of the channel (farthest from the walls) will not remove as much heat due to the limited mixing in a laminar flow channel. By introducing span-wise motion of the microparticles, mixing is introduced into channels, and there is therefore an improvement in the rates of heat removal from the heat source. As noted above, span-wise motion is motion of the particles induced by generation of an acoustic standing wave across a channel in which the positions of nodes (or antinodes) are varied to promote congregation of particles at these points. As the fluid flows, and the particles therefore move along the length of the channel, the position of the nodes (or antinodes) is varied, and this provokes a change in position of the particles in a direction that is orthogonal to the direction of the bulk fluid flow. As the particles travel lengthwise down the channel, due to fluid flow, and width-wise across the channel, due to the variation in position of nodes or antinodes, mixing is induced or effectively introduced in to the fluid flow.

Figure 6:
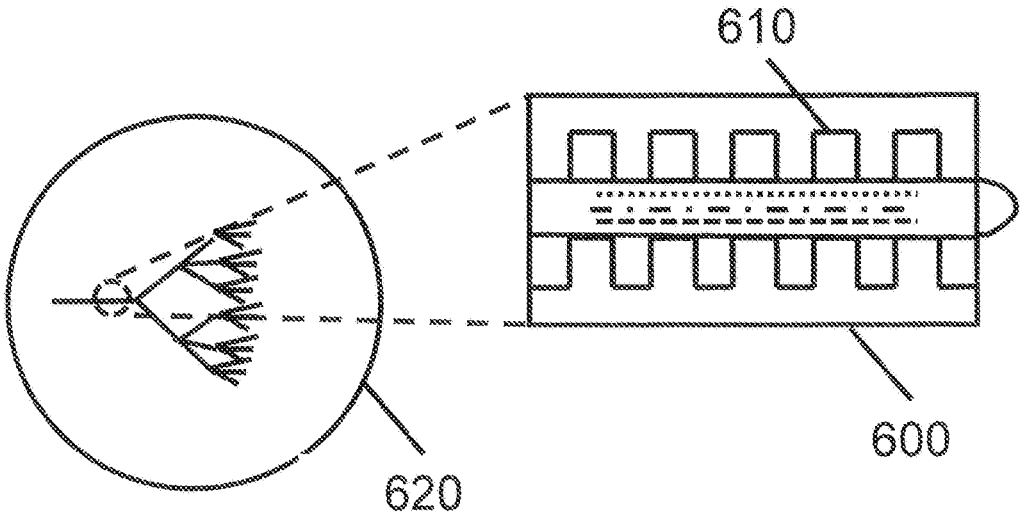
FIG. 6 is a schematic showing positioned particles inside a microchannel according to an example.

FIG. 6 is a schematic representation of positioning of biological particles inside a microchannel 600, where the particles are separated into layers using acoustophoretic forces (this is in contrast to the centripetal inertial forces approach). Similarly, to that described above, crenulations 610 introduce span-wise particle motion, which may be sinusoidal, depending on the nature of the profiles selected for example. Shear forces in this case are negligible, which means that the particles are not damaged.

According to an example, biological particles can be sorted into individual layers by introducing an ultrasonic standing wave span-wise across a channel. This can be used to sort particles per their acoustophoretic contrast factor. Small particles, or particles with compressibilities close to the solvent, will not be affected. Large particles, or particles with a high acoustophoretic contrast factor, will be sorted (as per FIG. 1). Therefore, by selecting parameters such as the solvent compressibility, the standing wave harmonic number, and the locations of the outflow channels, it is possible to isolate different biological particles into separate outflow channels.

A hierarchical network of such channels 620 may therefore be created (see left hand side of FIG. 6) to allow for fine control of particle separation. This process could be repeated for a hierarchical network of channels, or repeated with a different solvent to ensure different particle separations due to the change in acoustophoretic contrast factor. This process induced negligible shear stresses inside the channel, and therefore particles are less likely to be degraded by this process when compared to the existing centripetal inertial forces approach. Crenulations can be added to channel walls to introduce particle motion. This could be used in biomedical studies to bring specific cells in contact with a medicine embedded in a channel wall, for example.

Figure 7A:
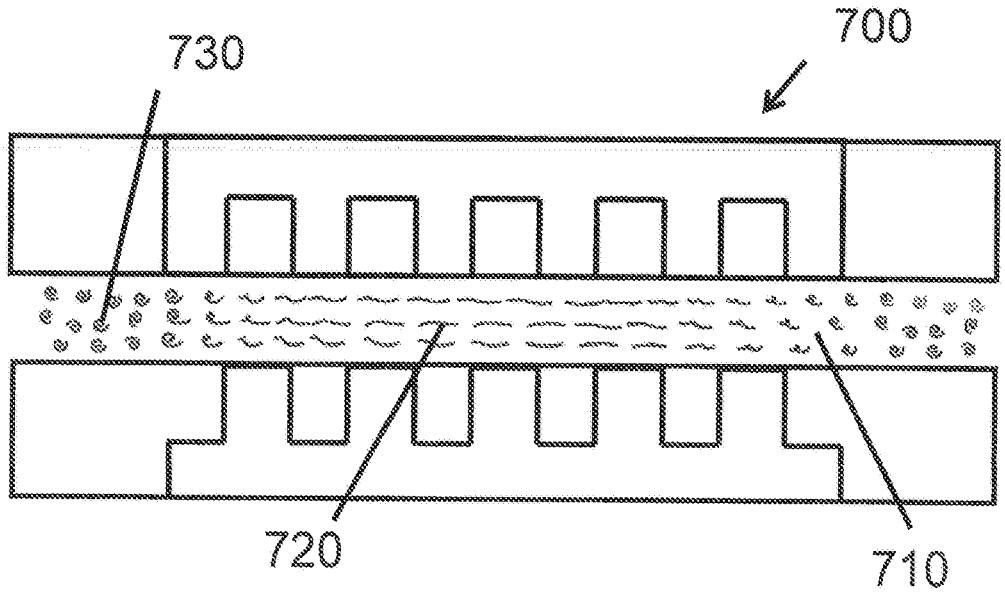
FIGS. 7A and 7B are schematics showing stresses in a polymer/solvent mixture based on use of an apparatus according to examples.
Figure 7B:
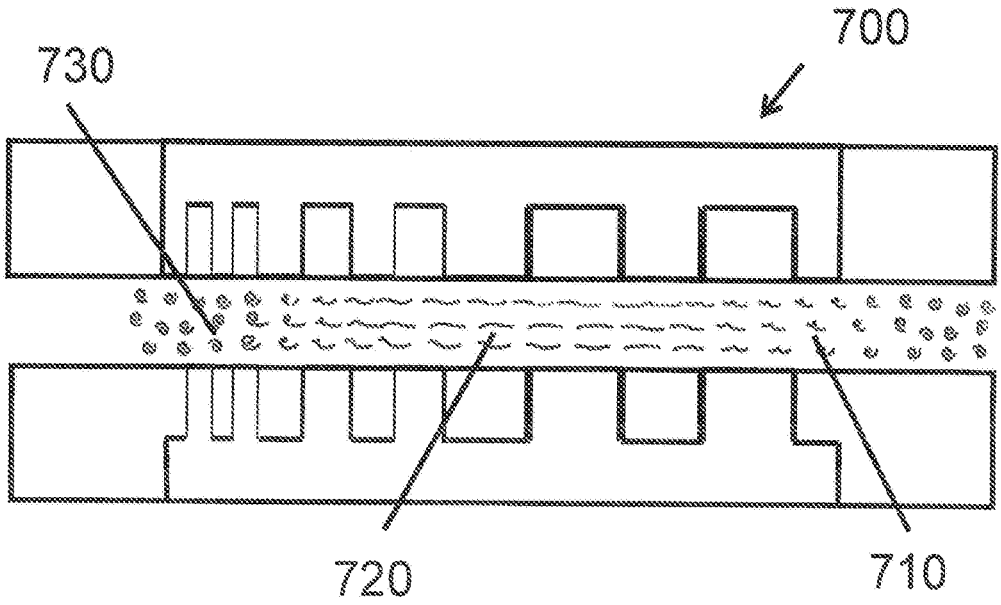

FIGS. 7A and 7B are schematic representations of an apparatus 700 according to examples for controlling the stresses in a polymer/solvent mixture 710. As shown in FIG. 7A, the crenulations may have a regular spacing. Alternatively, the crenulations may have a modulated spacing as shown in FIG. 7B. Polymer macromolecules are long chains of repeated monomer subunits. When these chains are stretched 720, energy is stored in the macromolecules (like a coiled spring under compression or tension). When this energy is released, and the macromolecules return to their coiled/disarrayed shape 730, this energy release can disturb the surrounding fluid and introduce localised turbulence. In these examples, the macromolecules can be stretched using acoustophoretic forces. This allows turbulence to be introduced at specific longitudinal locations along a microchannel, where turbulence is desirable (for example, to enhance convective heat transfer). This can also be used to achieve optofluidic effects.

Flow that exhibits mixing is advantageous as it can be used to enhance the circulation of the particles in the fluid, and allow more heat to be carried away from a heated wall structure adjacent to a device to a device to be cooled for example. This improves heat removal in examples where the cross-sectional length-scales of the channel are sub-millimetre, since in the absence of turbulence, the fluid flow will be laminar at any practical flow rates. The method described introduces turbulence such that mixing is no longer limited in a laminar flow regime, and hence the heat transfer capability of the particles is improved as they then migrate orthogonally to the mean flow direction in the microchannel.

In an example, the level of turbulence introduced into the surrounding fluid may be modulated according to the example shown in FIG. 7B. The resonance with the span-wise channel may be gradually faded in or out at the peripheral regions to smooth the transition of polymer macromolecules through the controlled stressed region between the acoustophoretic forces. This results in less disturbance of the surrounding fluid as the energy is more gradually stored through coiling and released through stretching. This may be used to achieve different optofluidic effects.

Thus, acoustophoretic forces (generated by a piezoelectric or other ultrasonic acoustic source) can be applied to stretch and otherwise manipulate polymer macroparticles in a solvent according to an example. This has many potential benefits across a range of applications. Assuming there is a significant contrast in the compressibilities of the polymer macroparticles and carrier solvent, the polymer particles will experience a significant drag force when placed in a standing wave field. Depending on the strength of this acoustophoretic force, the polymer particles may be stretched from their bundled, default state and flattened into a rod-like shape as the particles are forced into alignment with the node (or antinode) of the standing wave pressure field, as shown in the FIG. 7. If the standing wave is removed, this potential energy is released, which disturbs the surrounding fluid and introduce localised turbulence. This viscoelastic turbulence effect has the benefit of locally increasing heat transfer due to fluid mixing at low Reynolds Numbers (and hence low pumping powers).

The examples shown in FIGS. 7A and 7B also raise additional potential applications. When polymers are stretched, they exhibit birefringence effects. The coupled acoustofluidic and optofluidic effects can be used to perform modulated light polarization for telecommunications applications for example. The birefringence property can also be used to characterise the polymer in a low shear environment for polymer processing applications. Additionally, since the polymer solution rheology is dependent on the state of the polymer chains, the viscosity of the fluid can be engineered both spatially and temporally. This can have wide application from biomedical devices, such as non-invasive microfluidics valving, to flow control, adaptive wing activation in UAVs, and studies of DNA macromolecules.

According to an example, there is therefore provided a system and method for dispersing particles introduced into the fluid for microchannel cooling fluid, where the particles remain dispersed (and do not clump together) throughout the fluid during use, such that they are able to interact with a heated wall. This can be achieved based on efficient mixing of the fluid under normal microchannel operating conditions or through control of the motion of conductive particles in the fluid, which forces the particles closer to the heated wall and hence enhances the rate of heat transfer in microchannel-based cooling systems. An advantage of the arrangements provided herein include a more reliable method and system due to the removal of the need for large pumps (which can be unreliable, because, as the channel diameter is reduced in an array of parallel channels, the wetted surface is increased and thermal performance increases linearly but the pressure required to pump the fluid increases to the fourth power of channel diameter).

Examples provide non-destructive methods for manipulating and finely sorting biological particles such as cells. The shear rates that existing standard biological particle sorting methods employ can be detrimental to cell survival, whereas the shear rates achievable according to examples are minimal.

Examples described herein improve convective heat transfer by introducing mixing without requiring high flow rates and therefore untenable pumping requirements.

Examples can be embodied in other specific apparatus and/or methods. The described examples are to be considered in all respects as illustrative and not restrictive. In particular, the scope of the invention is indicated by the appended claims rather than by the description and figures herein. All changes that come within the meaning and range of equivalency of the claims are to be embraced within their scope.

The invention claimed is:

1. An apparatus for modifying the position of particles distributed in a fluid flow in a channel, the apparatus comprising:

a channel formed by two substrates, each of the two substrates being on opposite sides of the channel, each substrate having a periodic profile pattern along a length of the channel; and a transducer, wherein one of the substrates is between the transducer and the channel, the transducer to generate an acoustic standing wave within the channel with at least one node or antinode positioned within the channel, wherein the acoustic standing wave is induced by a pressure wave corresponding to a span-wise resonance frequency of the channel.

2. The apparatus as claimed in claim 1, wherein the pattern forms an interface having an acoustically reflective surface in order to reflect acoustic energy back into the channel to maintain the standing wave.

3. The apparatus as claimed in claim 1, wherein each substrate comprises a semi-conductor material.

4. The apparatus as claimed in claim 1, further comprising:

a material layer between the patterned substrate and the channel, the material layer having an acoustic impedance selected to substantially match that of a fluid to flow within the channel.

5. The apparatus as claimed in claim 4, wherein the material layer comprises polydimethylsiloxane.

6. The apparatus as claimed in claim 1, wherein the profile of the patterned substrate varies in a direction parallel to the channel.

7. The apparatus as claimed in claim 2, wherein interfaces between the channel and material are perforated at intervals to provide pores at the upper and lower channel interfaces that are out-of-phase with each other.

8. The apparatus as claimed in claim 6, wherein the profile comprises a series of notches and projections.

9. The apparatus as claimed in claim 6, wherein a distance from the base of a notch to the acoustically transmissive surface is an integer multiple of a distance from the top of a projection to the acoustically transmissive surface.

* * * * *